US009926049B2

(12) United States Patent
Fleischer et al.

(10) Patent No.: US 9,926,049 B2
(45) Date of Patent: Mar. 27, 2018

(54) CLOSED-LOOP CONTROL SYSTEM FOR CONTROLLING A DEVICE

(71) Applicant: LOCKHEED MARTIN CORPORATION, Bethesda, MD (US)

(72) Inventors: Corey Fleischer, Baltimore, MD (US); Alexander Boon, Baltimore, MD (US); William Kraft, Baltimore, MD (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 97 days.

(21) Appl. No.: 14/725,168

(22) Filed: May 29, 2015

(65) Prior Publication Data

US 2015/0259047 A1 Sep. 17, 2015

Related U.S. Application Data

(62) Division of application No. 12/552,175, filed on Sep. 1, 2009, now abandoned.

(51) Int. Cl.
*B63B 27/14* (2006.01)
*B66F 11/04* (2006.01)
(Continued)

(52) U.S. Cl.
CPC ..... *B63B 27/143* (2013.01); *B63B 27/14* (2013.01); *B66F 11/04* (2013.01); *B66F 11/044* (2013.01);
(Continued)

(58) Field of Classification Search
CPC ..... B65G 69/28; B65G 69/2817; B65G 69/2829; B63B 27/14; B63B 27/30;
(Continued)

(56) References Cited

U.S. PATENT DOCUMENTS 3,176,801 A 4/1965 Huff
3,409,923 A 11/1968 Walker
(Continued)

FOREIGN PATENT DOCUMENTS

GB 1009737 A 11/1965
GB 2097737 A 11/1982

OTHER PUBLICATIONS

European Patent Office (ISA); International Search Report dated Jul. 4, 2011, For International Patent Application No. PCT/US2010/047438.

*Primary Examiner* — Gary S Hartmann
(74) *Attorney, Agent, or Firm* — Kent E. Kemeny; Andrew M. Calderon; Roberts Mlotkowski Safran Cole & Calderon, P.C.

(57) ABSTRACT

A closed-loop hydraulic control system that may arrest the motion of attached devices in the event of loss of electrical or hydraulic power or in the event of an emergency. Gangways from a ship to a platform and ladders on fire trucks may have hydraulic control systems that allow for free motion in several different directions in order to keep stability in rough waters or shifting ground. If the gangway or ladder begins to fall due to loss of hydraulic power or a failure in the securing of one end, the closed-loop control system may detect these situations and actuate the closing of valves to limit or stop the falling motion of the gangway or ladder. Various control or damping algorithms may be employed to yield a desired and controlled arresting of motion.

20 Claims, 4 Drawing Sheets

(51) Int. Cl.

| | |
|---|---|
| ***E06C 5/04*** | (2006.01) |
| ***E06C 5/06*** | (2006.01) |
| ***F15B 20/00*** | (2006.01) |
| ***F15B 21/08*** | (2006.01) |
| *B63B 17/00* | (2006.01) |

(52) U.S. Cl.
CPC ..... *E06C 5/04* (2013.01); *E06C 5/06* (2013.01); *F15B 20/002* (2013.01); *F15B 21/08* (2013.01); *B63B 2017/0072* (2013.01); *F15B 2211/20561* (2013.01); *F15B 2211/27* (2013.01); *F15B 2211/40592* (2013.01); *F15B 2211/7054* (2013.01)

(58) Field of Classification Search
CPC ..... B63B 27/143; B63B 2017/0072; B63B 2027/141; E01C 5/06
USPC ..... 414/138.2, 138.3; 14/71.7
See application file for complete search history.

(56) References Cited

U.S. PATENT DOCUMENTS

| | | | | |
|---|---|---|---|---|
| 3,426,719 | A | 2/1969 | Mizell | |
| 3,543,318 | A | 12/1970 | Tushim | |
| 4,010,693 | A | 3/1977 | Bliss | |
| 4,365,374 | A | 12/1982 | Bennett | |
| 4,366,591 | A | 1/1983 | Zimmerman | |
| 4,603,832 | A | 8/1986 | Sjoquist | |
| 4,641,388 | A | 2/1987 | Bennett et al. | |
| 4,759,673 | A | 7/1988 | Pearce et al. | |
| 4,767,254 | A | 8/1988 | Kovach et al. | |
| 4,944,062 | A | 7/1990 | Walker | |
| 4,977,635 | A * | 12/1990 | Alexander | B65G 69/2823 14/71.3 |
| 4,979,253 | A * | 12/1990 | Alexander | B65G 69/2823 14/71.3 |
| 4,986,393 | A | 1/1991 | Preukschat et al. | |
| 5,285,027 | A | 2/1994 | Nakamura et al. | |
| 5,544,381 | A | 8/1996 | Alexander | |
| 5,570,935 | A | 11/1996 | Monzaki | |
| 5,730,855 | A | 3/1998 | Luebke et al. | |
| 5,784,740 | A | 7/1998 | Disieno et al. | |
| 6,067,490 | A | 5/2000 | Ichimaru et al. | |
| 6,163,913 | A | 12/2000 | Disieno et al. | |
| 6,176,192 | B1 | 1/2001 | Torkler | |
| 6,386,345 | B1 | 5/2002 | Hamilton et al. | |
| 6,659,703 | B1 * | 12/2003 | Kirkley | B63B 27/10 414/138.2 |
| 6,804,850 | B2 | 10/2004 | Alexander | |
| 6,955,134 | B2 * | 10/2005 | Prins | B63B 21/00 114/230.14 |
| 7,344,206 | B2 | 3/2008 | Schmidt | |
| 7,472,935 | B2 | 1/2009 | Love | |
| 7,996,942 | B2 * | 8/2011 | Fleischer | B63B 27/143 114/362 |
| 8,006,337 | B2 * | 8/2011 | Birmingham | B63B 27/143 114/362 |
| 8,091,694 | B2 | 1/2012 | Vervoordeldonk et al. | |
| 8,672,288 | B2 * | 3/2014 | van der Tempel | B63B 17/00 248/550 |
| 8,683,720 | B2 | 4/2014 | Ault | |
| 9,174,710 | B2 * | 11/2015 | van der Tempel | B63B 17/00 |
| 9,278,736 | B2 * | 3/2016 | Van Der Tempel | B63B 27/14 |
| 9,487,277 | B2 * | 11/2016 | van der Tempel | B63B 17/00 |
| 2006/0075586 | A1 | 4/2006 | Senior | |
| 2006/0102432 | A1 | 5/2006 | Matsumoto | |
| 2007/0114772 | A1 | 5/2007 | Evans | |
| 2008/0156602 | A1 | 7/2008 | Hiemenz et al. | |
| 2008/0201875 | A1 | 8/2008 | Grunewald | |
| 2010/0095835 | A1 | 4/2010 | Yuan et al. | |
| 2011/0047723 | A1 * | 3/2011 | Fleischer | B63B 27/14 14/69.5 |
| 2013/0198979 | A1 * | 8/2013 | Dudson | B63B 27/143 14/71.3 |
| 2015/0344110 | A1 * | 12/2015 | van der Tempel | B63B 27/14 114/230.2 |
| 2016/0144932 | A1 * | 5/2016 | Salen | B63B 27/143 700/275 |

* cited by examiner

CLOSED-LOOP CONTROL SYSTEM FOR CONTROLLING A DEVICE

BACKGROUND

Transporting crew members of ships from the ship to a location off-ship, such as to a nearby oil platform, can be challenging in times of inclement weather. Wave heights of 30-40 feet may be common in the high seas and wind speeds of 30-40 knots can be common, thus making getting on and off ships difficult because the ship may be listing about in relation to any nearby structure.

In the past, helicopters and/or cranes were used to lift and carry baskets that held crew. The crane or helicopter would engage and lift the basket and then carry the basket, with crew in tow, to the destination, e.g., from the ship to the platform. This method, however, is time-consuming and requires many levels of coordination both on and off the ship for arranging for crew members to get on or off the ship.

More recently, gangway techniques have been used wherein a free end of a ramp attached to the deck of a platform may be maneuvered to engage the nearby ship. Such techniques are only suitable for use in relatively low sea states since inclement weather may produce substantial movement of the ramp. Of course, substantial movement of the ramp poses safety risks to any crew members that may be using the ramp at the time.

BRIEF DESCRIPTION OF THE DRAWINGS

The foregoing aspects and many of the attendant advantages of the claims will become more readily appreciated as the same become better understood by reference to the following detailed description, when taken in conjunction with the accompanying drawings, wherein:

DETAILED DESCRIPTION

The following discussion is presented to enable a person skilled in the art to make and use the subject matter disclosed herein. The general principles described herein may be applied to embodiments and applications other than those detailed above without departing from the spirit and scope of the present detailed description. The present disclosure is not intended to be limited to the embodiments shown, but is to be accorded the widest scope consistent with the principles and features disclosed or suggested herein.

The subject matter disclosed herein is related to a closed-loop hydraulic control system that may arrest the motion of attached devices in the event of loss of electrical or hydraulic power or in the event of an emergency. Gangways from a ship to a platform and ladders on fire trucks may have hydraulic control systems that allow for free motion in several different directions in order to keep stability in rough waters or shifting ground. If the gangway or ladder begins to fall due to loss of hydraulic power or a failure in the securing of one end, the closed-loop control system may detect these situations and actuate the closing of valves to limit or stop the falling motion of the gangway or ladder. Various control or damping algorithms may be employed to yield a desired and controlled arresting of motion so as to prevent injury and damage.

Figure 1:
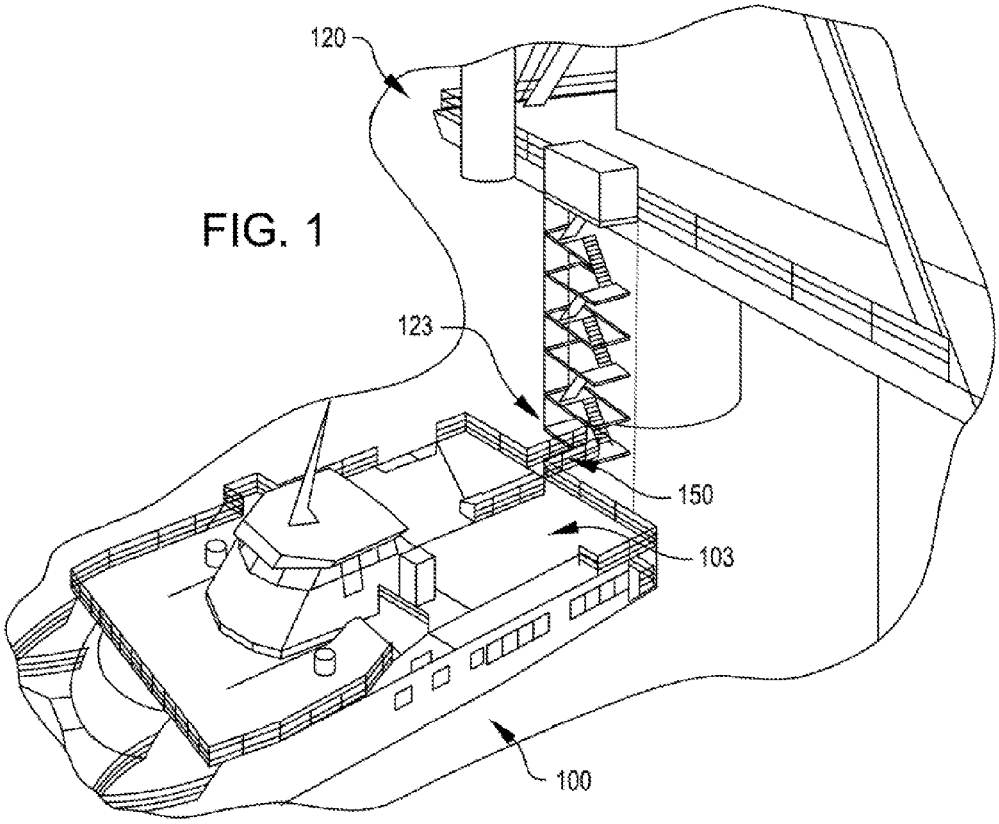
FIG. 1 shows an embodiment of a system including a vessel positioned next to a nearby platform.

FIG. 1 shows an embodiment of a system including a vessel 100 positioned next to a nearby platform 120. The vessel 100 may be anchored near the platform 120 for the purposes of loading or offloading crew and cargo to and from the platform 120. Thus, a gangway 150 may extend from the vessel 100 to the platform 120. Such a vessel 100 may be a cargo ship or personnel transport and the platform 120 may be an oil derrick or off-shore drilling facility. A skilled artisan will understand that the embodiments discussed herein may equally be applied to any vessel and any stationary platform on the ocean or other body of water.

In FIG. 1, one can see that the top deck 103 of the vessel 100 is below the lowest deck 123 of the platform 120. As such, the gangway 150 may be used to provide a coupling between the vessel 100 and the platform 120. Such a gangway 150 may be permanently fixed at one end to the top deck 103 of the vessel 100 and then maneuvered or lifted into position when needed for vessel ingress and egress. When in position, the other end of the gangway 150 may be removably attached to the lowest deck 123 of the platform 120. In other embodiments not depicted in FIG. 1, the top deck 103 of the vessel 100 may be above the deck of the platform 120 to be engaged. Thus, the gangway 150 may engage with different decks of the platform 120. In still further embodiments, the gangway 150 may be permanently fixed to the platform 120 and removably attached to the vessel 100 when in use. Various aspects of such a gangway 150 are described in greater detail in related U.S. Pat. No. 8,407,840 entitled SELF RELEASING CABLE SYSTEM and assigned to the same assignee of the present application and hereby incorporated by reference.

The gangway 150 may include an associated control mechanism (not shown in detail in FIG. 1) wherein an operator may maneuver the gangway 150 into a deployed position (i.e., attached to the nearby platform 120 as is shown in FIG. 1) or into a stored position on the deck 103 of the vessel 100. The gangway 150 may be stored for when the vessel 100 is underway and not needed. As such, the stored position may include additional securing means to prevent the gangway 150 from moving about while the vessel 100 is underway. Such storage mechanisms are not shown in detail in any FIG. Aspects of the control mechanism are described below with respect to FIGS. 2 and 3.

Figure 2:
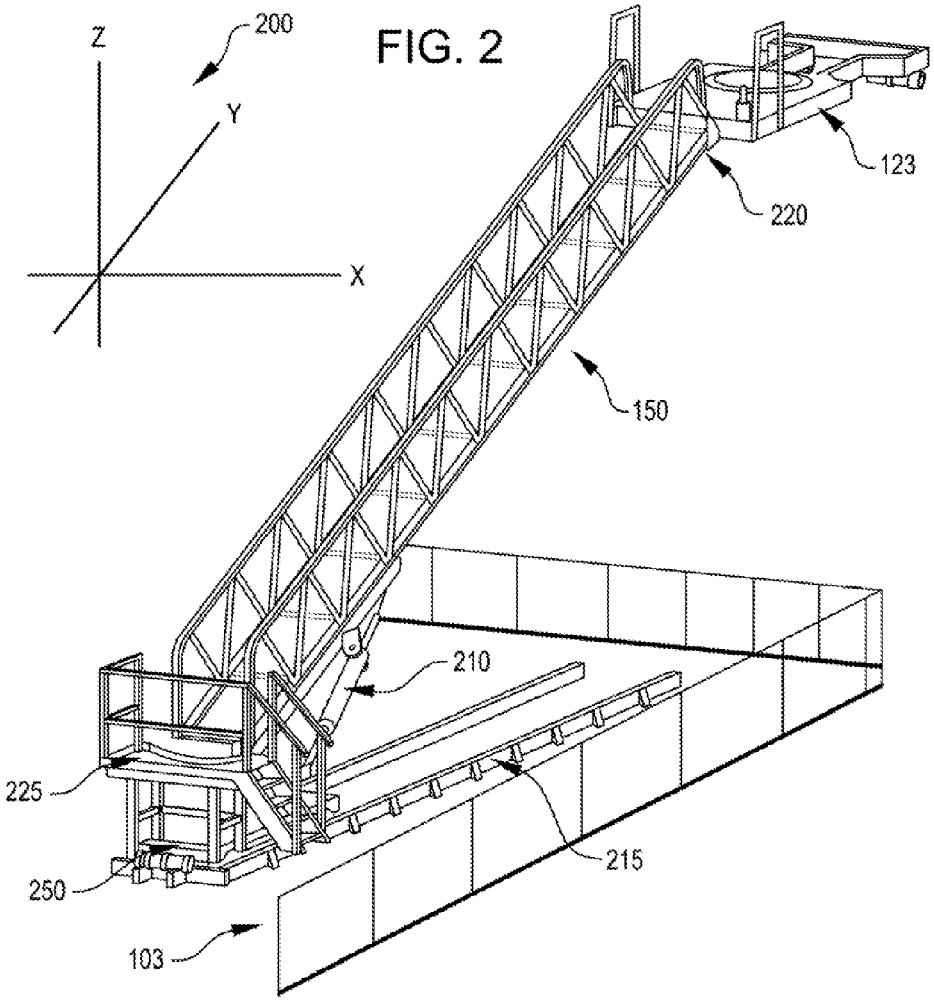
FIG. 2 shows an isometric view of an embodiment of a gangway that may be part of the system of FIG. 1.

FIG. 2 shows a more detailed isometric view of an embodiment of a gangway 150 that may be part of the system of FIG. 1. The gangway 150 may be permanently fixed to the top deck 103 of the vessel 100 (as described above) at a first end 225 of the gangway. Further, the other end, i.e., a second end 220 may be attached to a deck 123 of a nearby platform (FIG. 1). Thus, when the vessel requires crew and/or cargo to be loaded or off-loaded, the gangway 150 may be used for ingress of egress when coupled to the deck 123 of the platform (FIG. 1).

When a vessel 100 first arrives at the platform, the gangway 150 may be moved into position in a number of ways. In one embodiment, a winch (not shown) may lower cables to the second end 220 of the gangway 150 (which may be resting on the deck 103 of the vessel 100). Then, the winch may lift the second end 220 of the gangway 150 up to the deck 123 of the platform and attach the second end 220 to the deck 123. Such an attachment may not be permanent and is described in detail in related U.S. Pat. No.

8,407,840 entitled SELF RELEASING CABLE SYSTEM and assigned to the same assignee of the present application and hereby incorporated by reference.

In other embodiments, a control system 250 may control one or more hydraulics lifts 210 to maneuver the gangway 150 into place. Such a hydraulic control system 250 may include a number of hydraulic lifts 210 (all of which are not shown in detail) and may control the gangway 150 in several different directions, which are herein referred to as degrees of freedom. As is discussed below, the gangway 150 may be controlled by several hydraulic lifts 210—but for ease of illustration, only one hydraulic arm 210 is shown in FIG. 2.

The gangway 150 in the embodiment of FIG. 2 may be controlled (or free to move as discussed below) in at least six degrees of freedom. These six degrees of freedom may be described in terms in traditional axial direction in three dimensions. Coordinate system 200 shows an "X" axis, a "Y" axis, and a "Z" axis wherein each of these three directions may include a positive and a negative direction resulting in six degrees of freedom. In nautical terms, these axes are typically called the pitch axis ("X"), the roll axis ("Y") and the yaw axis ("Z") assuming the coordinates 200 are aligned as shown in FIG. 2 with the gangway 150 pointed directly back off the aft deck 103. The controller 250 as generally depicted in FIG. 2, may control (or allow) the movement of the gangway 150 in these directions.

Further, the first end 225 of the gangway 150 may be disposed on a rail system 215, such that the entire gangway 150 may be moved closer to or further from the platform as needed. That is, two additional degrees of freedom allow the entire structure to move forward or backward as needed. In terms of the coordinates 200, these degrees of freedom allow the entire coordinate system 200 to move linearly back forth at the origin 201.

Each of the afore-mentioned degrees of freedom may be enabled by hydraulics that are controlled by the controller 250. The controller 250 may be part of a hydraulic control system wherein the movement of the gangway 150 may be maneuvered or maintained about the roll, pitch and yaw axes respectively using hydraulics for each axis. The hydraulics for controlling movement about each axis are not shown in detail in FIG. 2, but the gangway 150 may be maneuvered in any direction using a combination of hydraulics available for moving the gangway 150. Thus, an operator may deploy the gangway 150 from a storage position to engage the deck 123 of the nearby platform.

Once in the deployed position and secured to the platform deck 123, as is generally depicted in FIG. 2, the hydraulics may be "opened up" to allow the free movement of the gangway 150 about any of the aforementioned axes. That is, the system allows for the ramp portion of the gangway 150 to remain relatively stationary when attached to a platform even though the vessel 100 may be listing and moving about. Thus, if the vessel 100 itself begins rolling about its roll axis, the gangway 150 hydraulics simply allow the gangway 150 to freely rotate about the roll axis, thereby keeping the gangway 150 relatively stationary. Similarly, if the vessel's bow pitches up, thereby lowering the aft, the hydraulics allow the gangway 150 to freely rotate about the pitch axis. Likewise, similar free rotation is available about the yaw axis if the vessel begins to rotate about its yaw axis.

Because the hydraulic system allows for the free movement of the gangway 150, a problem may arise if the second end 220 of the gangway becomes disengaged or if power is lost while maneuvering the gangway. Essentially, with no hydraulic pressure to control or arrest the movement of the gangway 150, gravitational forces cause the gangway to come crashing down to the deck 103. Obviously, a crashing gangway 150 is dangerous to any nearby person and may also cause great damage to the gangway and/or the vessel. Thus, a closed loop control system 250 may prevent this dangerous situation as is discussed with respect to FIG. 3.

Figure 3:
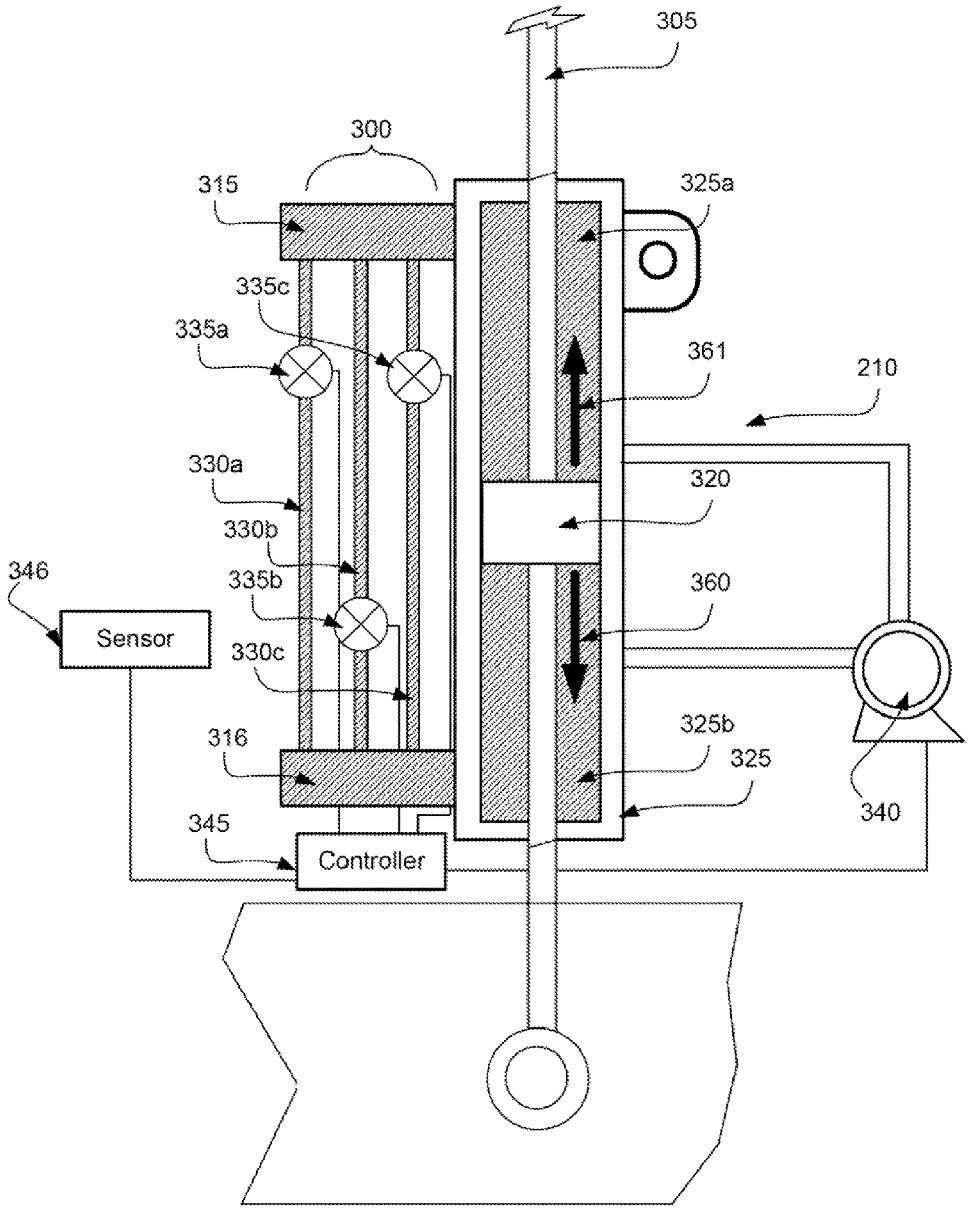
FIG. 3 shows a cutaway view of an embodiment of a closed-loop control system for maneuvering a device that may be part of the system of FIG. 1.

FIG. 3 shows a cutaway view of an embodiment of a closed-loop control system 250 for maneuvering a device e.g., a gangway 150 (FIG. 2) that may be part of the system of FIG. 1. The system 250 may include a hydraulically-controlled extension arm 305 that may be operatively coupled to a gangway (FIG. 2) or other device to be maneuvered. The arm 305 is coupled to a piston 320 that is inside a hydraulic chamber 325. As is known in the art, a hydraulic pump 340 may pump fluid from the top side 325*a* into the bottom side 325*b* of the chamber to push the piston 320 up, thereby causing the arm 305 to extend as the piston 320 moves in the upward direction 361. Similarly, the hydraulic pump 340 may pump fluid from the bottom side 325*b* of the chamber 325 to the top side 325*a*, thereby causing the arm 305 to retract as the piston 320 moves in the downward direction 360. By controlling the hydraulic pump 340, an operator may manually extend or retract the hydraulic arm 305 by using a controller 345. In other embodiments, the controller 345 is automated. Thus, if each degree of freedom as discussed above is associated with a hydraulic system 210 as shown in FIG. 3, an operator may have control over each degree of freedom and the controller 345 may arrest motion in any degree of freedom upon detecting an event, such as loss of power or an emergency.

Once an operator has maneuvered the attached device (e.g., the gangway 150 (FIG. 2) into place using one or more hydraulic systems 210 as shown in FIG. 3, each hydraulic system may be set to allow free motion of its respective piston 320. This is desirable when the gangway is secured to both the vessel deck and the platform deck. As the vessel moves (i.e., pitches, rolls, or yaws), such vessel motion will not place forces upon the hydraulics as the piston 320 is free to allow the hydraulic arm 305 to extend or retract. If the gangway is allowed to freely move in each degree of freedom when deployed, then undue stress in any direction can be avoided.

As alluded to above, however, this also is problematic if the gangway is dislodged from the attachment to the platform due to mechanical failure or the need for the vessel to quickly depart the platform in an emergency. Therefore, a closed-loop control system 250 may be used to arrest the movement of the hydraulics in any situation where the hydraulics may have failed. A sensor 346 may detect one or more of these situations and engage the controller 345 to react. Thus, the sensor 346 may be an emergency release button or a motion sensor/proximity sensor that determines if the second end of the gangway becomes dislodged from the platform deck.

The closed loop control system 250 may have one or more cylinders 315 and 316 mounted to the hydraulic chamber 325 such that hydraulic fluid may flow into each cylinder chamber. Each cylinder 315 and 316 may also have one or more hydraulic lines 330*a*-330*c* that hydraulically couples each cylinder 315 and 316 to each other. In this manner, hydraulic fluid above and below the piston 320 may be joined and allowed to move freely between the upper chamber 325*a* and the lower chamber 325*b*. Further, the movement of hydraulic fluid between chambers may be stopped or limited via line valves 335*a*-335*c*. Depending on the situation, these valves 335*a*-335*c* may be open or closed in varying patterns.

When the hydraulic system is being used to deploy or retract a gangway, these valves 335*a*-335*c* are closed so that the hydraulic pump 340 can pump fluid from one chamber to the other (e.g., from upper 325*a* to lower 325*b* when extending and vice versa when retracting). However, when the gangway is deployed and free motion is desired, these valves 335*a*-335*c* are fully open and the piston 320 is free to move up and down with hydraulic fluid being moved from one chamber to the other. Then, if an emergency arises requiring immediate release from the platform, if power is lost, or if any other circumstance causes the gangway to begin falling, these valves 335*a*-335*c* may be closed immediately (or according to a controlled damping algorithm) to prevent hydraulic fluid from flowing, presumably from the lower chamber 325*b* to the upper chamber 325*a* because gravity is causing the hydraulic arm 305 to retract. Different methods may be employed for different situations to yield a desired damping rate for the particular degree of freedom as discussed below.

The valves 335*a*-335*c* may be configured to close at different rates and may be configured to fail to different positions in an effort to provide the safest arresting of gangway motion. The valves 335*a*-335*c* may be electric, pneumatic or hydraulically controlled and are configured to be normally closed. Thus, for a normally closed valve, if power or valve control capability is lost, the valves will fail to a closed position such that hydraulic fluid is prevented from flowing in the hydraulic lines 330*a*-330*c*. Again, by preventing the flow of hydraulic fluid between chambers 325*a* and 325*b*, the attached gangway may be locked into place until the hydraulic fluid can be moved in a safer and controlled manner.

Table 1, below, shows different damping rates for a single degree of freedom to be controlled. Based upon whether none, one, two, or three valves are closed, a different damping rate may be enabled for arresting motion is the specific degree of freedom.

TABLE 1

| Damping Rate | Position of Valve A | Position of Valve A | Position of Valve A |
|---|---|---|---|
| Lowest Damping Rate | OPEN | OPEN | OPEN |
| Damping Rate = ~525000 Newton · seconds per meter (N · s/m) (3000 pound · seconds per inch (lb · s/in)) | CLOSED | OPEN | OPEN |
| Damping Rate = ~700000 N · s/m (~4000 lb · s/in) | CLOSED | CLOSED | OPEN |
| Fully Locked | CLOSED | CLOSED | CLOSED |

In one embodiment, each valve is physically the same and will close at the same rate to the normally closed position. Thus, all flow of hydraulic fluid will be stopped and the gangway will be secured in place, i.e., fully locked. Closing the combination of valves this manner may result in an exponential damping rate such that the damping gradually gets to be higher and higher until the hydraulics are fully locked. An operator may then manually allow some hydraulic fluid to flow by opening one or more valves 335*a*-335*c*. Further, one or more valves 335*a*-335*c* may be partially opened to allow only a desired level of motion, e.g., one of the damping rates of Table 1 or other damping rates not specifically identified in Table 1, such as any damping rate ranging from 0 N·s/m to 1050000 N·s/m or more (0 lbs·s/in to 6000 lbs·s/in or more).

In other embodiments, each valve 335*a*-335*c* has a different closing rate such that fluid flowing from one chamber to another is gradually slowed down by successively closing each valve. Thus, a first valve 335*a* may close in one second, a second valve 335*b* may close in two seconds and a third valve 335*c* may close in three seconds, thereby softly "catching" the gangway as it is falling instead of slamming all the valves closed. Such a closing algorithm may be referred to as a linearly-stepped damping function wherein the damping rate is linear (with respect to time) when valves are not closing (e.g., steady-state) but then changes rapidly to a different damping rate as a valve is closed.

In yet another embodiment, the controller 345 may recognize an emergency situation. In this scenario, power may still be available to control the gangway and related closed-loop system valves, but the need to quickly yet safely retract the gangway exists. Thus, the valves 335*a*-335*c* may be controlled according to a specific algorithm for lowering the gangway. One method includes starting the valve closing at intervals. When an emergency situation is actuated e.g., an operator presses and emergency retract button, the method may begin by closing the first valve 335*a* at a first time, such as, for example, 1.0 seconds after the button is pressed. Then the second valve 335*b* may be closed at a next interval, for example at 1.5 seconds after the button is depressed. Finally, the third valve 335*c* may be closed at a third time, for example, at 2.0 seconds after the button is depressed.

Figure 4:
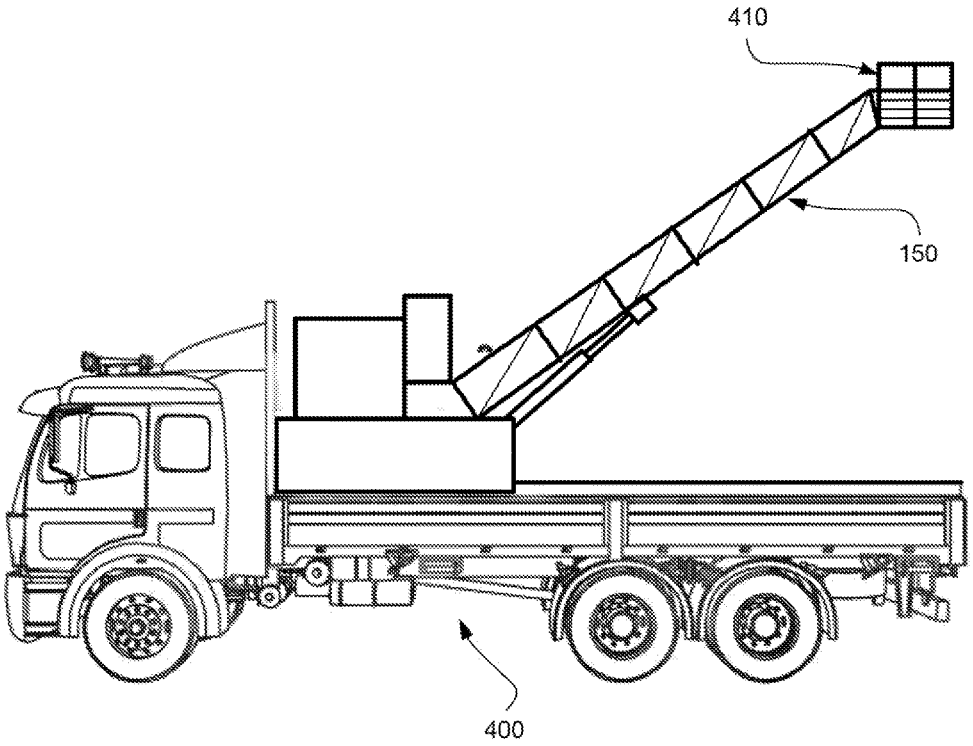
FIG. 4 shows an embodiment of a vehicle having a closed-loop control system of FIG. 3 for controlling a ladder system.

FIG. 4 shows another embodiment of the closed-loop control system of FIG. 3 wherein the system is used on a ladder-truck 400 or man-lift. Such a closed-loop control system may be used to protect against power loss or hydraulic loss failures when a person may be in a basket 410 or at the top of a ladder. If hydraulics fail when a person is being lifted, the closed-loop hydraulic system of FIG. 3 may safely arrest a falling ladder or basket 410.

While the subject matter discussed herein is susceptible to various modifications and alternative constructions, certain illustrated embodiments thereof are shown in the drawings and have been described above in detail. It should be understood, however, that there is no intention to limit the claims to the specific forms disclosed, but on the contrary, the intention is to cover all modifications, alternative constructions, and equivalents falling within the spirit and scope of the claims.

What is claimed:

1. A system, comprising:

a gangway;

a hydraulic control system operable to hydraulically maneuver the gangway into deployment and operable to allow free motion of the gangway when deployed; and at least one control valve operable to limit the free motion upon the determination of an event, wherein the at least one control valve comprises:

a first valve having a first closing rate;

a second valve having a second closing rate different than the first closing rate; and a third valve having a third closing rate different than the first closing rate and the second closing rate.

2. The system of claim 1 wherein the gangway further comprises:

a first end configured to be permanently attached to a deck of a vessel; and a second end configured to be removably attached to the deck of a platform.

3. The system of claim 2 wherein the first end of the gangway further comprises rails that allow movement of the gangway in a linear direction on the deck of the vessel.

4. The system of claim 1 further comprising a controller operable to:

detect the event; and actuate the valve element according to a pre-determined damping algorithm.

5. The system of claim 4, wherein the predetermined algorithm comprises an algorithm to yield a damping rate of approximately 4000 footpound-seconds per inch.

6. The system of claim 4, wherein the predetermined algorithm comprises an algorithm to yield a damping rate that begins at approximately of 0 footpound-seconds per inch and ends approximately of 4000 footpound-seconds per inch.

7. The system of claim 1, wherein the hydraulic control system comprises:

a hydraulic chamber;

a piston inside the hydraulic chamber between a top side of the hydraulic chamber and a bottom side of the hydraulic chamber;

a pump configured to pump fluid into one of the top side of the hydraulic chamber and the bottom side of the hydraulic chamber to move the piston relative to the hydraulic chamber;

a first cylinder fluidically connected to the top side of the hydraulic chamber;

a second cylinder fluidically connected to the bottom side of the hydraulic chamber; and at least one hydraulic line hydraulically coupling the first cylinder and the second cylinder, wherein the at least one control valve is arranged in the at least one hydraulic line to control flow of fluid in the at least one hydraulic line.

8. The system of claim 7, wherein:

the at least one hydraulic line comprises a first hydraulic line, a second hydraulic line, and a third hydraulic line, each hydraulically coupling the first cylinder and the second cylinder; and the first valve is in the first hydraulic line, the second valve is in the second hydraulic line, and the third valve is in the third hydraulic line.

9. The system of claim 8, wherein:

the first valve, the second valve, and the third valve are each closed when the hydraulic control system is maneuvering the gangway into a deployed position; and the free motion of the gangway is caused by the first valve, the second valve, and the third valve each being open when the gangway is in the deployed position.

10. The system of claim 8, wherein each of the first valve, the second valve, and the third valve are a normally closed valve that will fail to a closed position when power or valve control capability is lost.

11. The system of claim 8, wherein:

the system comprises a sensor configured to detect the event; and based on the sensor detecting the event, a controller closes each of the first valve, the second valve, and the third valve to limit the free motion of the gangway.

12. The system of claim 11, wherein:

the controller closes the first valve at a first time after the sensor detects the event;

the controller closes the second valve at a second time after the sensor detects the event;

the controller closes the third valve at a third time after the sensor detects the event; and the first time, the second time, and the third time are different from one another.

13. The system of claim 11, wherein the sensor comprises an emergency button that is pressable by an operator.

14. The system of claim 11, wherein the sensor comprises a motion or proximity sensor configured to detect that the gangway has become dislodged from a platform deck.

15. The system of claim 1, wherein:

the at least one valve is closed when the hydraulic control system is maneuvering the gangway into a deployed position;

the free motion of the gangway is caused by the at least one valve being open when the gangway is in the deployed position; and the at least one valve is a normally closed valve that will fail to a closed position when power or valve control capability is lost.

16. The system of claim 15, wherein:

the system comprises a sensor configured to detect the event;

based on the sensor detecting the event, a controller closes the at least one valve to limit the free motion of the gangway; and the sensor comprises one of: an emergency button that is pressable by an operator; and a motion or proximity sensor configured to detect that the gangway has become dislodged from a platform deck.

17. The system of claim 1, wherein:

a controller closes the first valve at a first time after the determination of the event;

the controller closes the second valve at a second time after the determination of the event;

the controller closes the third valve at a third time after the determination of the event; and the first time, the second time, and the third time are different from one another.

18. A system, comprising:

a gangway;

a hydraulic control system operable to hydraulically maneuver the gangway into deployment and operable to allow free motion of the gangway when deployed; and at least one control valve operable to limit the free motion upon the determination of an event, wherein the hydraulic control system further comprises:

a first hydraulically controlled arm for maneuvering the gangway about a roll axis;

a second hydraulically controlled arm for maneuvering the gangway about a yaw axis; and a third hydraulically controlled arm for maneuvering the gangway about a pitch axis.

19. A system, comprising:

a gangway;

a hydraulic control system operable to hydraulically maneuver the gangway into deployment and operable to allow free motion of the gangway when deployed; and at least one control valve operable to limit the free motion upon the determination of an event, wherein:

the hydraulic control system has at least one hydraulic line; and the at least one control valve comprises a set of valve elements comprising at least one first valve element and at least one second valve element and configured to allow dampened movement of the gangway according to a first non-zero damping rate.

20. The system of claim 19, further comprising:

a sensor configured to detect the event; and a control device configured to close the at least one first valve element at a first rate and configured to close the at least one second valve element at a second rate to change the damping rate of the movement of the gangway upon detection of the event by the sensor to a second non-zero damping rate.

* * * * *